United States Patent [19]

Leung et al.

[11] Patent Number: 5,026,050

[45] Date of Patent: Jun. 25, 1991

[54] EXERCISE APPARATUS

[75] Inventors: Paul Leung, 8145 Ohio River Blvd., Emsworth, Pa. 15202; Ansel M. Schwartz, Pittsburgh, Pa.

[73] Assignee: Paul Leung, Pittsburgh, Pa.

[21] Appl. No.: 492,783

[22] Filed: Mar. 13, 1990

[51] Int. Cl.[5] ..... A63B 23/00

[52] U.S. Cl. ..... 272/143; 272/67; 272/142

[58] Field of Search ..... 272/73, 74, 75, 140, 272/141, 142, 143, 901, 67, 68, 96, 137, 134

[56] References Cited

U.S. PATENT DOCUMENTS

| | | | |
|---|---|---|---|
| 3,762,704 | 10/1973 | Gingras | 272/75 |
| 4,157,179 | 6/1979 | Ecklor | 272/901 |
| 4,272,072 | 6/1981 | Kusmer | 272/143 |
| 4,483,533 | 11/1984 | Mangiapane | 272/143 |
| 4,949,951 | 8/1990 | Deola | 272/143 |

*Primary Examiner*—Stephen R. Crow
*Attorney, Agent, or Firm*—Ansel M. Schwartz

[57] ABSTRACT

An apparatus for exercising. The apparatus is comprised of a first extension and a second extension. Each extension is collapsible for portability, but rigid when deployed. Additionally, each extension has in proximity to its first end a pad. The pad is connected to the extension such that it can rotate and translate to a desired position and then be fixed relative to the extension. Each pad has a deployable handle with which to grip the extension and move it. Each pad also has an opening within which the handle can be disposed when not deployed. The apparatus is also comprised of a device for providing resistance to the first and second extension when they are moved relative to each other. The first and second extensions extend from and are connected to the resistance providing means. The user exercises muscles in his legs by placing the pads between his legs and closing his legs against the resistance of the apparatus. The user exercises muscles in his upper body by gripping the handles of the apparatus and bringing his arms together against the resistance of the apparatus.

6 Claims, 3 Drawing Sheets

EXERCISE APPARATUS

FIELD OF THE INVENTION

The present invention is related to exercise equipment. More specifically, the present invention is related to exercise equipment that is portable and what can be used to strengthen the lower and upper body muscles of a user.

BACKGROUND OF THE INVENTION

Exercise equipment is available to work all the different muscle groups of the body. As most intelligent exercisers know, an important aspect of exercising is regulatory of routine both over time and over exercises performed. For many exercisers in today's society, the demands of their jobs sometimes require them to work long hours or to travel away from home. In such circumstances, this may disrupt the regular routine of the exerciser either because equipment is not available to use, or equipment is available but it is different from the equipment they normally use. What would be ideal is for an exerciser to be able to have his equipment with him whenever he desires to exercise.

The present invention is portable and collapsible in order to be carried with the exerciser, or put in a convenient location without requiring a lot of space. The present invention also allows the exerciser to work at least his legs, as well as his lower body, upper body and more depending on the exerciser's imagination.

SUMMARY OF THE INVENTION

The present invention pertains to an apparatus for exercising. The apparatus is comprised of a first extension and a second extension. Each extension is collapsible for portability, but rigid when deployed. Additionally, each extension has in proximity to its first end a pad. The pad is connected to the extension such that it can rotate and translate to a desired position and then be fixed relative to the extension. Each pad has a deployable handle with which to grip the extension and move it. Each pad also has an opening within which the handle can be disposed when not deployed. The apparatus is also comprised of means for providing resistance to the first and second extension when they are moved relative to each other. The first and second extensions extend from and are connected to the resistance providing means.

The user exercises muscles in his legs and lower body by placing the pads between his legs and closing his legs against the resistance of the apparatus. A user exercises the muscles in his upper body by gripping the handles of the apparatus and bringing his arms together against the resistance of the apparatus.

BRIEF DESCRIPTION OF THE DRAWINGS

In the accompanying drawings, the preferred embodiments of the invention and preferred methods of practicing the invention are illustrated in which.

DESCRIPTION OF THE PREFERRED EMBODIMENT

Figure 1:
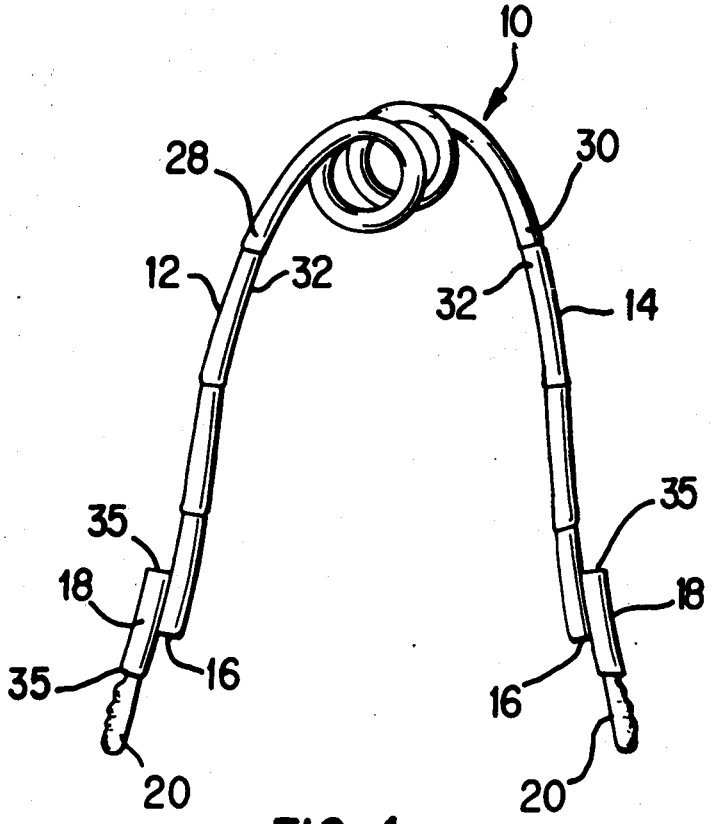
FIG. 1 is a perspective view of an exercise apparatus.

Referring now to the drawings, wherein like reference numerals refer to similar or identical parts throughout the several views and more specifically to FIG. 1 thereof, there is shown an apparatus 10 for exercising. The apparatus 10 is comprised of a first extension 12 and a second extension 14. Each extension is collapsible for portability but rigid when deployed.

Figure 4:
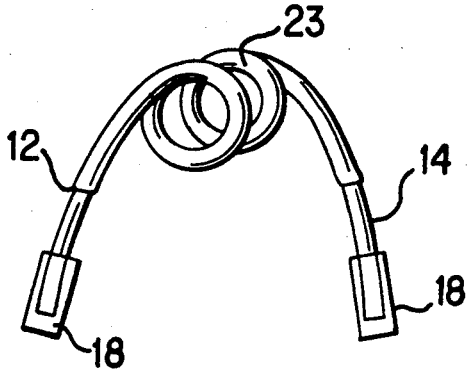
FIG. 4 is a perspective view of the exercise apparatus when it is collapsed.
Figure 6:
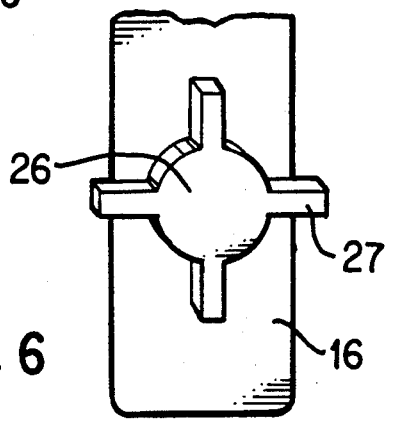
FIG. 6 is a side view of the knob and a portion of the extension of the exercise apparatus.
Figure 5:
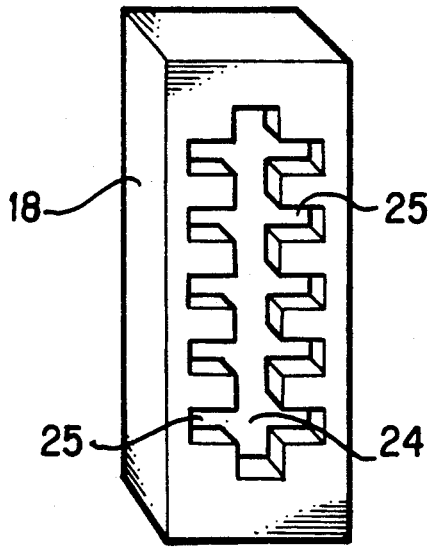
FIG. 5 is a side view of the pad.

Each extension preferably can telescope such that when not in use, each extension can be collapsed for portability or convenience of storage as shown in FIG. 4. Each extension has in proximity to its first end 16, a pad 18. The pad 18 is connected to the extension such that it can rotate and translate to a desired position with respect to the first end 16 of the extension and then be fixed relative to the first end 16. Preferably, each pad 18 has a second opening 24, as shown in FIG. 5, and each extension has a knob 26, as shown in FIG. 6, that is received by the second opening 24 such that it can rotate and translate to a desired position with respect to the first end 16 of the extension and then be fixed relative to the first end 16.

Figure 2:
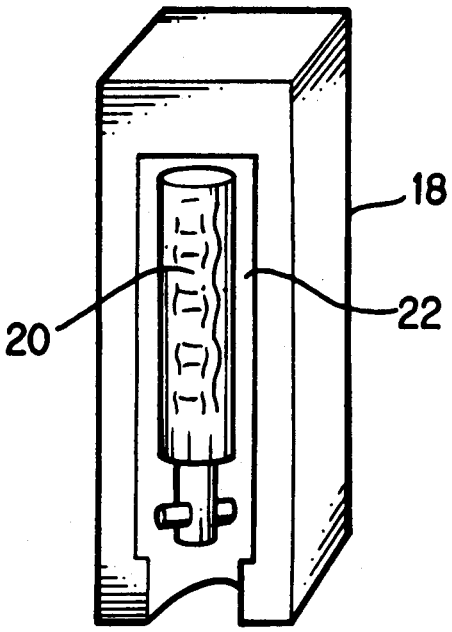
FIG. 2 is a side view of a pad of the exercise apparatus.
Figure 3:
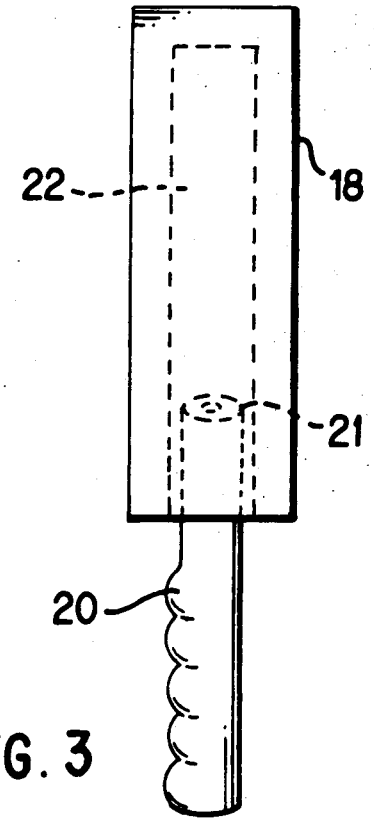
FIG. 3 is a side view of a pad with a handle in its deployed state of the exercise apparatus.

Each pad 18 has a deployable handle 20 with which to grip the extension and move it. Each pad 18 also has an opening 22 within which the handle 20 can be disposed when not deployed as shown in FIG. 2. The handle 20 is preferably rotatably connected to the pad 18 such that the handle 20 can be moved out of the opening 22 so that it is fixed relative to and aligned with the extension when deployed as shown in FIG. 3.

The apparatus 10 additionally has means for providing resistance to the first extension 12 and second extension 14 when they are moved relative to each other. The first extension 12 and second extension 14 extend from and are connected to the resistance providing means. Preferably, the resistance providing means is a spring 23 that has a spring constant that allows the muscles of the upper body of a user or the muscles of the legs and lower body of a user to bring the first extension 12 and second extension 14 towards each other and against the resistance of the spring 23. As the muscles of the user develop, the user is able to bring the first extension 12 and second extension 14 closer together during each repetition.

Preferably, the spring 23 has a first end 28 and a second end 30 connected to a second end 32 of the first extension 12 and second extension 14, respectively.

Figure 7:
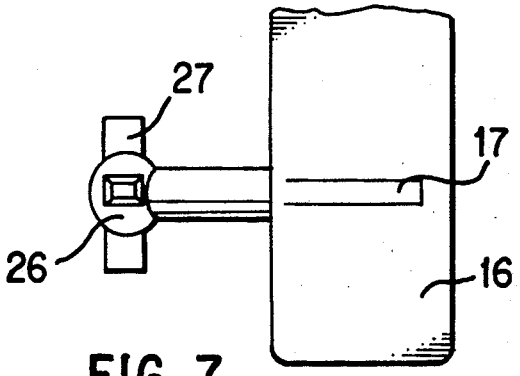
FIG. 7 is a side view of the knob and a portion of the extension.
Figure 8:
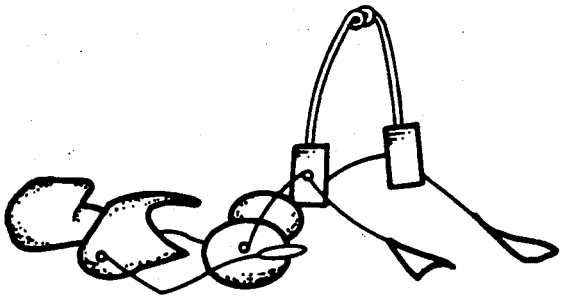
FIG. 8 is a schematic representation of a user in a first position exercising his knees and lower body with the exercise apparatus.
Figure 9:
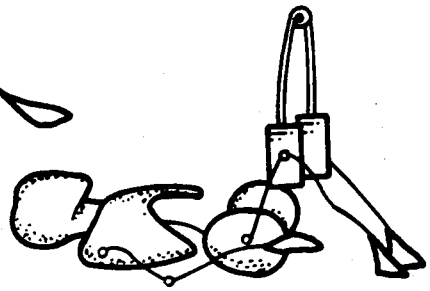
FIG. 9 is a perspective view of a user in a second position exercising his legs and lower body with the exercise apparatus.
Figure 10:
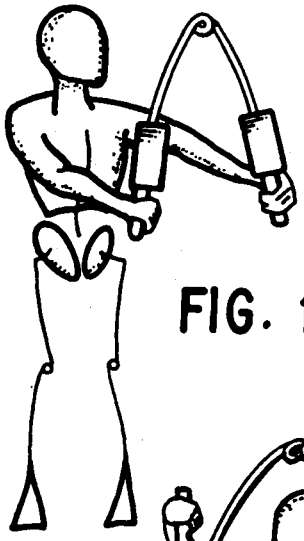
FIG. 10 is a schematic view of an exerciser in a first position exercising his upper body.
Figure 11:
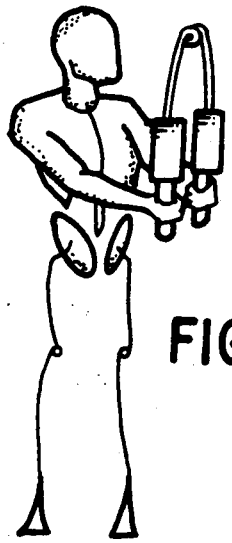
FIG. 11 is a schematic representation of an exerciser in a second position exercising his upper body with the exercise apparatus.

The operation of the invention the apparatus 10 has its first extension 12 and second extension 14 telescoped out to the furthest extent. Each pad 18 is adjusted to a desired position relative to the end 16 of each extension by lock 17 shown at FIG. 7 being depressed causing the fingers 27 on knob 26 to retract. With fingers 27 of knob 26 retracted the knob 26 is released from the slots 25 in the second opening 24 so that the knob 26 can be moved in alignment with a desired slot 25. The lock 17 is then released causing the fingers 27 of the knob 26 to extend and catch in place in the proper slots 25. The apparatus 10 is then placed between the knees of an exerciser as shown in FIG. 8 such that the pads contact the inside part of the thighs of the exerciser. Straps 35, as shown in FIG. 1, can be used to hold the apparatus 10 to the lower part of the body to facilitate exercise. The exerciser then squeezes his legs together to exercise muscles in his leg against the resistance of the spring 23. The exerciser then releases his legs to allow the apparatus 10 to return towards original shape and then repeats the procedure for as long as desired to obtain the desired physiological response. Alternatively, the exerciser can depress lock 17 causing the fingers 27 to retract into (knob pad 26) to allow the pad 18 to be rotated 90 degrees such that the pad 18 is now essentially perpendicular with each extension. The lock 17 is released causing the fingers 27 to extend out of the knob 26 and lock into the respective slots 25 with second opening 24. The exerciser then places the pads 18 between the insides of his upper arms as shown in FIG. 10. The exerciser then brings his arms together, which are bent at the elbows to facilitate the movement and increase support of the apparatus 10 there between, against the resistance of the spring 23 as shown in FIG. 11. The exerciser then allows his arms to move apart consequently allowing the apparatus 10 to return to its original position. The exerciser then repeats this procedure for as long as desired to achieve desired physiological response.

Figure 12:
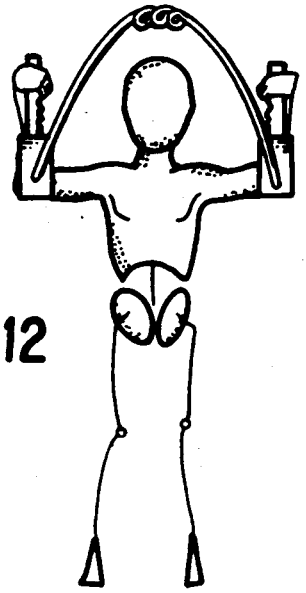
FIG. 12 is a schematic representation of an exerciser holding the handles of the exercise apparatus and exercising his upper body.
Figure 13:
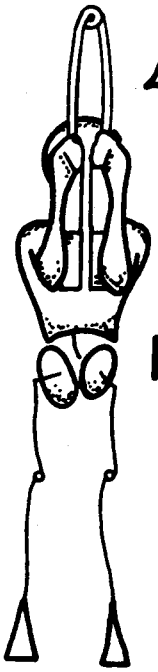
FIG. 13 is a schematic representation of an exerciser holding the handles of the exercise apparatus and exercising his upper body.

The exerciser here also exercises the upper body by taking the handle 20 that is stored in the first opening 22 of the pad 18, shown in FIG. 2 and deploying it such that the handle 20 can be gripped by the exerciser shown in FIG. 3. A handle 20 cannot deploy further then desired since the back 21 of the opening 20 prevents it from deploying further than desired. The exerciser then grips each handle 20, shown in FIG. 12 and then brings his hands together, shown in FIG. 13 against the resistance of the spring 23. The exerciser then allows his hand to move apart consequently allowing the apparatus 10 to return to its original position. The exerciser can then repeat this procedure for as long desired to achieve desired physiological results. It should be noted that the first extension 12 and the second extension 14 do not telescope in during the exercising procedures since the force supplied to the first extension 12 and second extension 14 is in direction perpendicular to the direction the first extension 12 and the second extension 14 telescope.

Preferably, after the exerciser is finished exercising the first extension 12 and second extension 14 telescoped into the first furthest extent and the apparatus 10 is placed in a suitcase or stored in a desired location.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. An apparatus for exercising comprising:

a first extension and a second extension, each extension being collapsible for portability but rigid when deployed, each extension having in proximity to its first end a pad, said pad connected to the extension such that it can rotate and translate to a desired position and then be fixed relative to the extension, each pad having a deployable handle with which to grip the extension and move it, an opening in the pad in which the handle can be disposed when not deployed, the handle rotatably connected to the pad such that the handle can be moved out of the opening until it is fixed relative thereto and aligned with the extension when deployed, each pad having a second opening and each extension having a knob that is received by the second opening such that the pad can rotate and translate with respect to the first end of the extension and then be fixed relative to the first end; and means for providing resistance to the first and second extension when they are moved relative to each other, said first and second extension extending from and connected to the resistance providing means.

2. An apparatus as described in claim 1 wherein each extension can telescope.

3. An apparatus as described in claim 2 wherein the resistance providing means is a spring that has a first end and a second end connected to a second end of the first and second extension, respectively.

4. An apparatus as described in claim 3 wherein each pad has a strap.

5. An apparatus as described in claim 1 wherein the extensions are foldable.

6. An apparatus as described in claim 5 wherein the handle of the pad is retractable.

* * * * *